United States Patent [19]

Konno et al.

[11] Patent Number: 4,909,674

[45] Date of Patent: Mar. 20, 1990

[54] UNDERGROUND CONTINUOUS IMPERVIOUS WALL AND METHOD FOR INSTALLING SAME

[75] Inventors: Shozo Konno; Nobuyuki Matsui, both of Tokyo, Japan

[73] Assignee: Kajima Corporation, Tokyo, Japan

[21] Appl. No.: 196,617

[22] Filed: May 19, 1988

[30] Foreign Application Priority Data

| | | | |
|---|---|---|---|
| May 28, 1987 | [JP] | Japan | 62-132918 |
| May 28, 1987 | [JP] | Japan | 62-132919 |
| Jun. 3, 1987 | [JP] | Japan | 62-139497 |
| Jun. 3, 1987 | [JP] | Japan | 62-139498 |
| Jun. 10, 1987 | [JP] | Japan | 62-144951 |

[51] Int. Cl.[4] ..... E02D 5/20

[52] U.S. Cl. ..... 405/267; 405/266; 405/270

[58] Field of Search ..... 405/267, 270, 266, 109, 405/45, 48, 268, 287; 206/494, 820

[56] References Cited

U.S. PATENT DOCUMENTS

| | | | |
|---|---|---|---|
| 3,286,435 | 7/1963 | Weinberger | 206/494 X |
| 3,485,413 | 12/1969 | Vestal | 206/494 X |
| 3,759,044 | 9/1973 | Caron et al. | 405/267 |
| 3,884,355 | 5/1975 | Eriksson | 206/494 |
| 4,484,835 | 11/1984 | van Klinken | 405/270 X |
| 4,519,729 | 5/1985 | Clarke, Jr. et al. | 405/267 X |
| 4,582,453 | 4/1986 | Ressi Di Cervia | 405/267 |
| 4,601,615 | 7/1986 | Cavalli | 405/267 |
| 4,664,560 | 5/1987 | Cortlever | 405/267 |
| 4,671,705 | 6/1987 | Nussbaumer et al. | 405/267 |

*Primary Examiner*—Randolph A. Reese
*Assistant Examiner*—J. Russell McBee
*Attorney, Agent, or Firm*—James H. Tilberry

[57] ABSTRACT

An underground continuous water-impervious wall is disclosed, which includes a water-impervious membrane to partition a trench and to prevent water from passing through the wall. The trench as formed in the ground has a narrow width. The impervious sheet is lowered into the trench to partition the trench longitudinally. A hardening material is charged against the opposite side surfaces of the impervious sheet in the trench and solidified, whereby a water-impervious wall is obtained, with the impervious sheet sandwiched between opposite side wall portions. The impervious sheet is disposed in the trench by lowering the sheet in the form of a roll, lowering the sheet pre-stretched between posts, or lowering a pleated sheet pre-packed in a sheet cartridge. Adjacent sheets are connected to each other by female and male fasteners.

8 Claims, 19 Drawing Sheets

FIG.18(a)
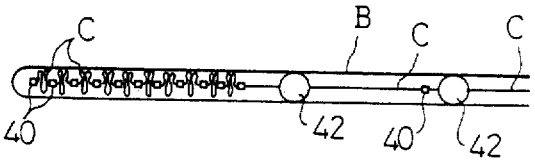
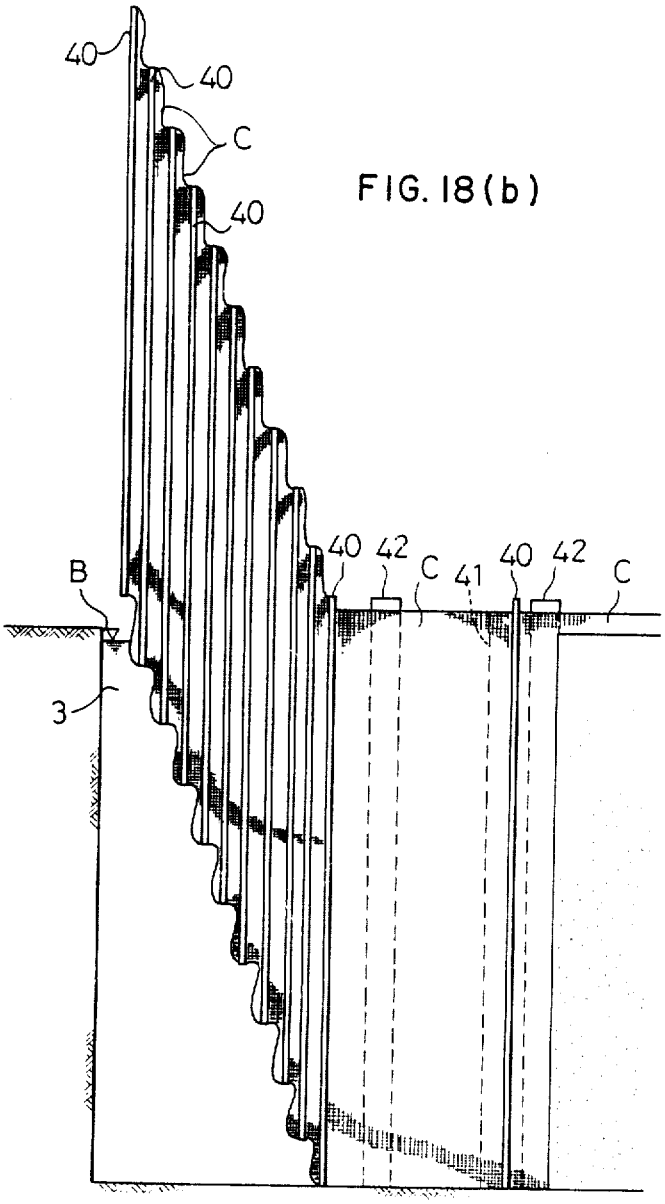
FIG. 18(b)

UNDERGROUND CONTINUOUS IMPERVIOUS WALL AND METHOD FOR INSTALLING SAME

This invention relates to construction of an underground continuous waterproof wall and a method for installing the same. More particularly, the invention relates to an underground continuous water-impervious wall obtained by vertically positioning a series of interconnected water-impervious plastic membranes in a slit trench, charging and hardening the same.

DESCRIPTION OF THE PRIOR ART:

For blocking underground spring water during construction of an underground building or blocking underground water in dam construction works, it has been a practice to construct an underground continuous wall by driving piling and charging a seaming material at the joints. Such prior art processes are unsatisfactory for several reasons.

Prior art water damming walls are usually thicker than necessary because there have been no means for excavating narrow trenches. Therefore, unnecessarily elaborate forms must be prepared, and an excessive quantity of concrete has to be used to fill these forms. This increases the installation cost. Also, the process of driving the piling and charging the seaming material at the joints requires elaborate preparation and high cost of material and labor. Even if a sufficiently narrow trench could be excavated, concrete is not sufficiently fluid to permit the pouring of a homogeneous underground wall. In addition, water-damming concrete walls are vulnerable to cracking caused by earthquake tremors, thus destroying the water-blocking property of the wall.

SUMMARY OF THE INVENTION

The underground continuous water-impervious wall according to the present invention uses a water-impervious plastic membrane to partition a narrow slit trench and to prevent water from passing through the wall. The trench is excavated in the ground by special and novel excavating equipment. The impervious membrane is lowered into the trench to longitudinally partition the trench into two parts. A hardening material is charged onto the opposite side surfaces of the impervious sheet and permitted to harden. Thus, a laminated wall is formed with its center comprised of a polyolefin plastic sheet, such as polyethylene, or any other impervious membrane. The invention contemplates a plurality of different processes for installing the impervious wall, and there are also several different processes for installing the impervious sheet.

In a first embodiment, the impervious sheet is wound on a roller, and then this sheet roll is lowered vertically into the trench. Then the sheet is unwound from the roller to extend along the trench.

In another embodiment of the present invention, a plurality of steel posts are used, and the impervious sheet is stretched between adjacent posts. The posts are lowered into the trench at a predetermined interval to stretch the impervious sheet.

In a further embodiment of the present invention, the impervious sheet is housed in a cartridge to facilitate its stretching in the trench. The cartridge has a vertically continuous folding groove section formed by a plurality of parallel partition members. The impervious sheet is foldedly accommodated in each folding groove section of the cartridge. The impervious sheet is secured via a space rod detachably provided at a folding portion located at the bottom of each folding groove section in the impervious cartridge. The cartridge with the impervious sheet therein is lowered into the trench, and the impervious sheet is pulled out to be stretched in the trench by pulling out the space rods.

By unwinding the impervious sheet from a roller or stretching the sheet between posts or lowering the sheet in the cartridge into the trench, the sheet can be accurately stretched in the trench.

The present invention further contemplates a process for connecting together adjacent impervious sheets. Adjacent sheets are provided with respective female and male fasteners. The female and male fasteners are provided on the trailing and leading edges, respectively, of the impervious sheet. The fasteners are vertically continuous in a rail-like form and have hook-like sectional profiles. The male fastener is engaged in the female fastener of the preceding impervious sheet, and the succeeding impervious sheet is lowered to provide a continuous impervious sheet.

The installation work consists of excavating the trench, stretching the impervious sheet and solidifying the mud or charging the soil mortar.

Since the completed impervious wall includes the impervious sheet intervening between the opposed hardened side wall portions, cracks in the wall due to earthquake tremors will not cause the wall to leak so long as the intervening sheet is not ruptured. Further, even if a portion of the wall of reduced mechanical strength is produced, the water-impervious sheet will maintain the integrity of the water-damming function of the wall.

Further, in case of soil formations having satisfactory self-supporting characteristics, the installation cost can be further reduced by using a soft and inexpensive filler, e.g., soil mortar, after the stretching of the sheet.

By winding the impervious sheet on a roller or stretching the sheet between posts or packaging the sheet in a pleated sheet cartridge, the sheet can be readily stretched in the trench without possibility of entangling of the sheet.

Further, by using female and male fasteners for connecting together the adjacent impervious sheets, the integrity of the water seal is maintained from sheet to sheet.

OBJECTS OF THE INVENTION

It is among the objects of the invention to provide a waterproof underground retaining wall adapted to protect a construction site from water seepage.

It is another object of the invention to provide a waterproof underground retaining wall that is laminated with a water-impervious membrane.

It is a further object of the invention to provide a waterproof underground retaining wall in which a water-impervious membrane is sandwiched with a hardening substance on each side of the membrane.

It is another object of the invention to provide a waterproof underground retaining wall that will retain its water damming properties even if cracked due to earthquake tremors.

It is another object of the invention to provide novel means of constructing a thin, lightweight, waterproof underground wall.

It is a further object of the invention to provide novel means of installing a thin, lightweight, waterproof underground retaining wall in a narrow slit trench.

It is a still further object of the invention to provide a novel waterproof underground retaining wall membrane in sections which may be joined together with novel fastener means adapted to maintain the waterproof integrity of the wall.

BRIEF DESCRIPTION OF THE DRAWINGS

The other objects and features of the present invention will become apparent from the following description of a preferred embodiment of the invention with reference to the accompanying drawings, in which:

FIG. 2(*b*) is a schematic elevational view of the earth preparation shown in plan view in FIG. 2(*a*);

FIG. 3(*b*) is a schematic elevational view of the earth preparation shown in plan view in FIG. 3(*a*);

FIG. 4(*b*) is a schematic elevational view of the earth preparation shown in plan view in FIG. 4(*a*);

FIG. 5(*b*) is a schematic elevational view of the slit trench and impervious plastic membrane shown in FIG. 5(*a*);

FIG. 9(*b*) is a schematic elevational view of the slit trench and rolled sheet of water-impervious plastic membrane shown in FIG. 9(*a*);

FIG. 10(*b*) is a schematic elevational view of the slit trench and the partially unrolled water-impervious plastic membrane;

FIG. 11(*b*) is a schematic elevational view of the slit trench and water-impervious plastic membrane shown in FIG. 11(*a*);

FIG. 12(*b*) is a schematic elevational view of the slit trench and water-impervious plastic membrane shown in FIG. 12(*a*);

FIG. 16(*b*) is an elevational view of the method shown in FIG. 16(*a*);

FIG. 17(*b*) is an elevational view of the method shown in FIG. 17(*a*);

FIG. 18(*a*) is a plan view of yet another phase of installation of the method shown in FIG. 17(*a*);

FIG. 18(*b*) is an elevational view of the method shown in FIG. 18(*a*);

FIG. 27(*b*) is a plan view in section similar to FIG. 27(*a*) showing the water-impervious plastic membrane being paid out from the cartridge;

FIG. 32(*b*) is a schematic plan view of an inflated trench-blocking bladder tube employed as an integral part of the water-impervious plastic membrane;

DESCRIPTION OF THE PREFERRED EMBODIMENT

Figure 1:
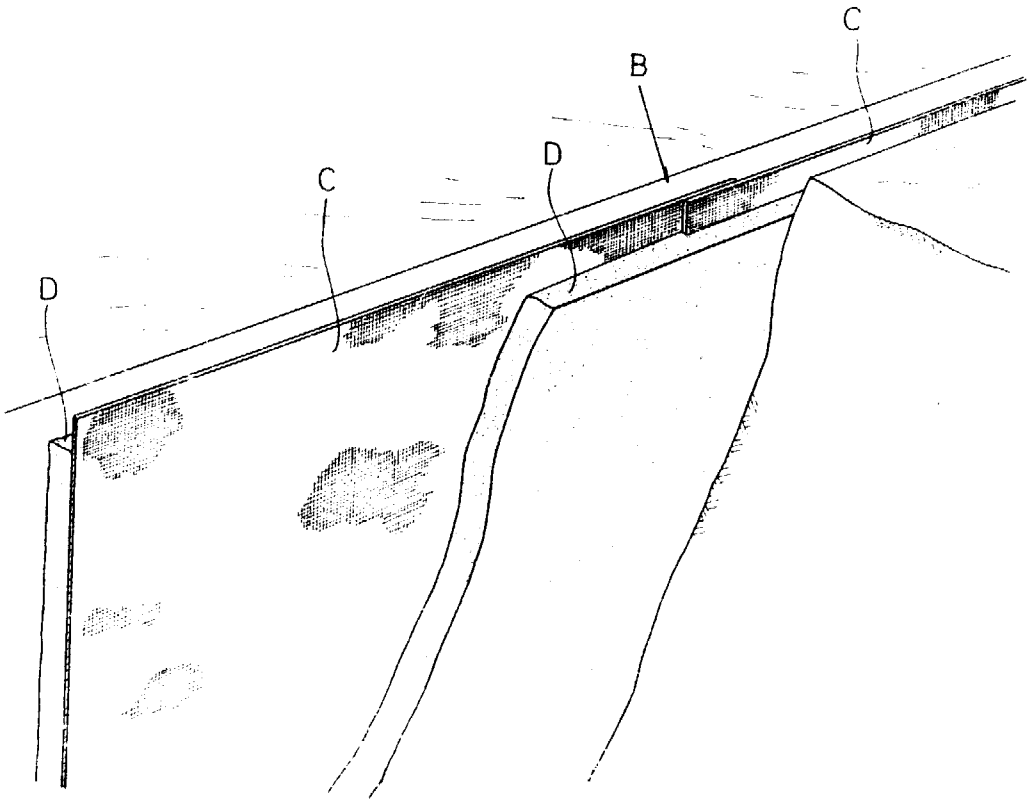
FIG. 1 a perspective view, partially fragmentary, showing an underground continuous water-impervious wall in accordance with a preferred embodiment of the invention.
Figure 2:
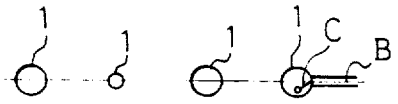
FIG. 2(*a*) is a schematic plan view of a preliminary step in preparing the earth for trenching in accordance with a preferred embodiment of the invention.

Referring first to FIG. 1, therein is shown a slit trench B in which have been inserted overlapping sheets of stretched water-impervious plastic membranes C which have been stiffened on each side by hardening material D.

FIGS. 2 to 6 illustrate a preferred process of installing an underground continuous impervious wall according to the present invention. The process will now be described step by step.

(1) Boring

A plurality of bore holes 1 are bored at suitable intervals in the ground. The bore holes 1 may not have fixed diameters. It is possible that only a bore hole in which a guide post 4 of an excavating apparatus A is inserted may have an increased diameter. The boring of the bore holes 1 is performed while charging mud 3.

When the boring is done in soil formations consisting of rock, for instance, having satisfactory self-supporting character, mud is unnecessary, and the boring is possible without water.

(2) Excavating apparatus

Figure 6:
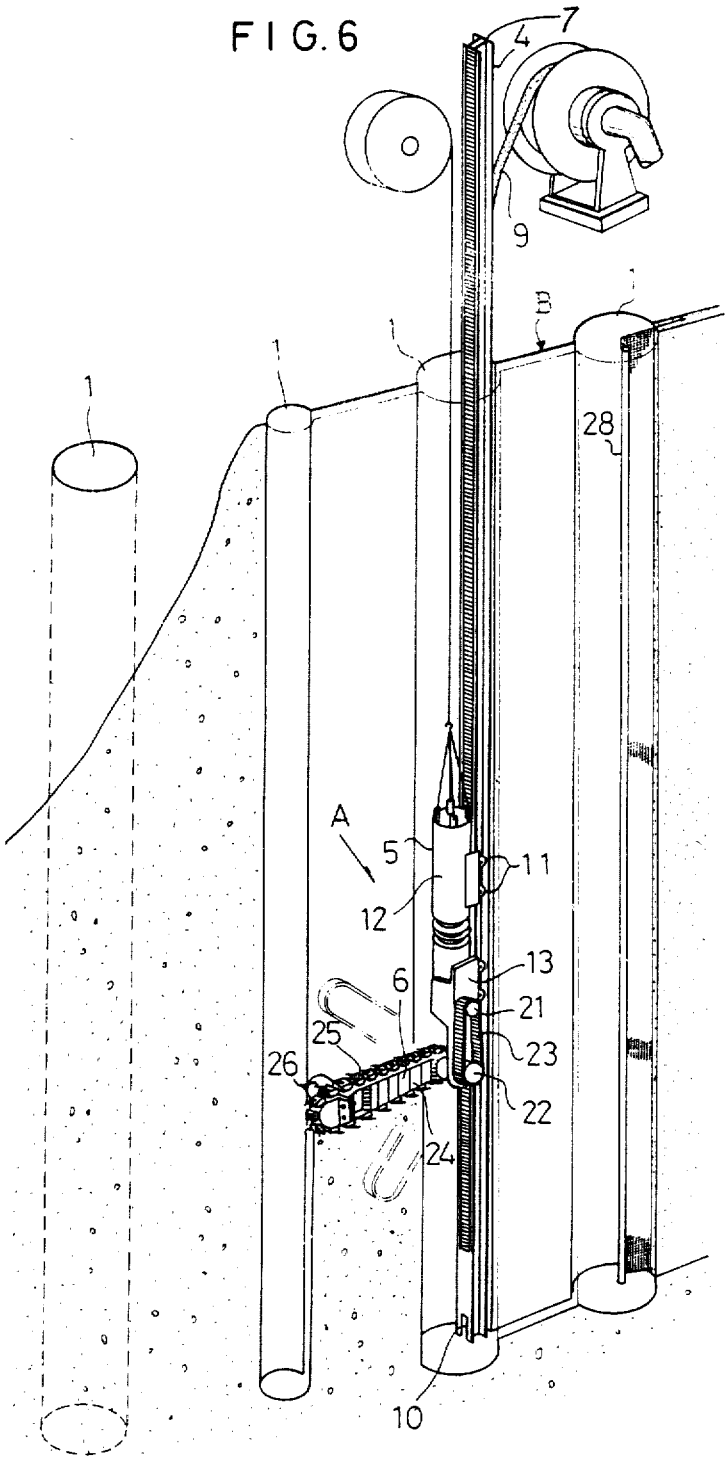
FIG. 6 is a partially fragmentary elevational perspective view of the trenching apparatus shown schematically in FIG. 3(*b*)
Figure 7:
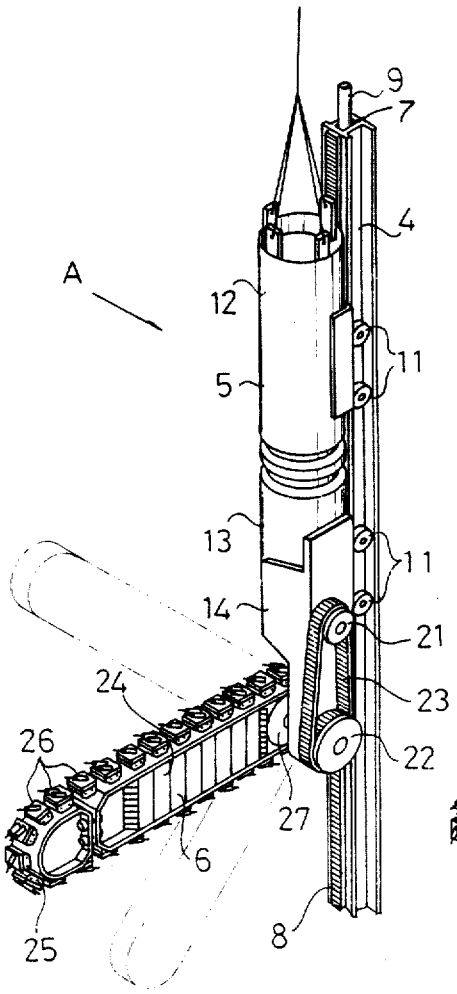
FIG. 7 is an enlarged fragmentary perspective view of the trenching head of the trenching apparatus shown in FIG. 6.
Figure 8:
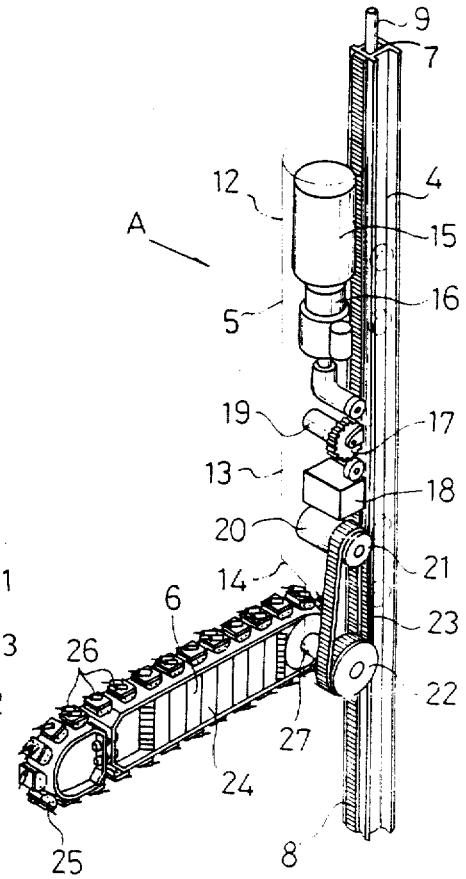
FIG. 8 is an enlarged fragmentary view of the trenching head shown in FIG. 7, but with the protective shroud removed.
Figure 9A:
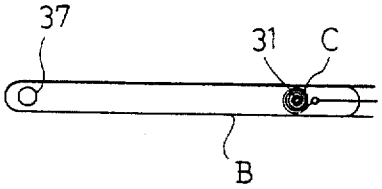
FIG. 9(*a*) is a schematic plan view of a slit trench showing therein a rolled sheet of water-impervious plastic membrane.

The excavating apparatus A as shown in FIGS. 6, 7 and 8 comprises a guide post 4, a drive unit 5 and a saw unit 6. The guide post 4 is a hollow pillar-like member having an inner space 7. It has a rack 8 formed on one side over the entire length thereof. A hose 9 for pumping out a slurry of mud and excavated earth is passed through the space 7, so that the slurry can be withdrawn through slurry inlet 10, FIG. 6, formed at the lower end of the guide post 4.

The drive unit 5 is vertically movable along the guide post 4 and is provided on its outer periphery with a plurality of guide rollers 11 in engagement with the guide post 4 for this purpose. The drive unit 5 includes a power unit 12, a control unit 13 and a bracket 14 for mounting a saw. In the power unit 12, a hydraulic pressure tank 15 and a motor-driven hydraulic power unit 16 are accommodated. A movable sprocket 17 and a control box 18 are accommodated in the control unit 13. The movable sprocket 17 is in mesh with the rack 8 of the guide post 4. A drive motor 19 is driven by the motor-driven power unit 12 to rotate the movable sprocket 17 so as to move the drive unit 5 vertically. In the control unit 13, a saw drive motor 20 is also accommodated, and a saw drive sprocket 21 mounted on the saw-mounting bracket 14 is rotated by the motor-driven power unit 12. A saw drive sprocket 22 is mounted on the end of the saw-mounting bracket 14, and an endless saw drive chain 23 is passed around the sprocket 22 and saw drive sprocket 21.

The saw unit 6 includes a saw frame 24 and a chain 25 having teeth 26. The saw frame 24 has one end rotatably mounted on the saw-mounting bracket 14 and rotatable with the saw drive sprocket 22 of the saw-mounting bracket 14. The endless chain 25 is rotatably passed round the saw frame 24. The chain 25 is narrow in width, and it has a plurality of teeth 26 secured to its links constituting the outer periphery of the saw unit 6. The chain 25 is driven for rotation by a chain drive motor 27.

(3) Excavation of the trench

A narrow trench B, FIG. 6, is excavated using the excavating apparatus A as described above. First, the guide post 4 of the excavating apparatus A is installed in a bore hole 1. The movable sprocket 17 is rotated by the drive motor 19 of the drive unit 5 so that it lowers the drive unit 5 along the rack 8 of the guide post 4 in mesh with the movable sprocket 17. The chain 25 is driven by the chain drive motor 27 so that the chain 25 of the saw unit 6 excavates the earth between adjacent bore holes 1. Since the saw unit 6 is narrow, the trench B will have a similar narrow width, and the trench, therefore, can be readily excavated.

The excavation is performed while continuously charging the mud into the trench B. The earth removed by excavation is withdrawn together with mud through inlet 10 at the lower end of the guide post 4 to be discharged to the outside of the trench B through the hose 9. The removed slurry is replaced by the continuous charging of mud into the excavated portion of the trench.

When excavation is difficult, the saw unit 6 is rotated to change its angle of attack by pivotally shifting the saw unit 6 about sprocket 22, FIG. 7.

When excavation is completed to the same depth as the bore hole 1, the orientation of the saw unit 6 in the excavating apparatus A is changed or.

(4) Stretching of water-impervious sheets

A water-impervious sheet C is stretched in the mud-filled trench B which has been excavated to a predetermined length and depth in the manner described above. An impervious sheet C, not shown, is connected to a joint 28, FIG. 6, of the already stretched impervious sheet C to longitudinally partition the trench B into two narrower lengths.

(5) Solidification of mud

Figure 3A:
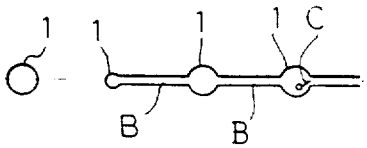
FIG. 3(*a*) is a schematic plan view of a step in earth preparation subsequent to the step illustrated in FIG. 2(*a*)
Figure 2B:
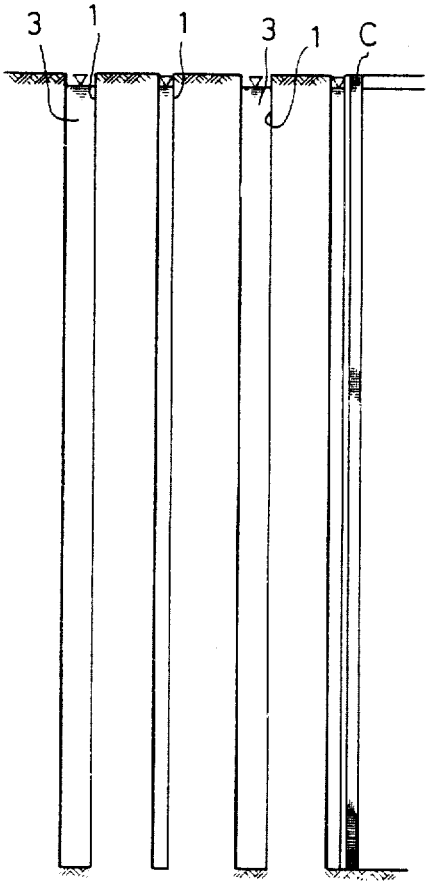
Figure 3B:
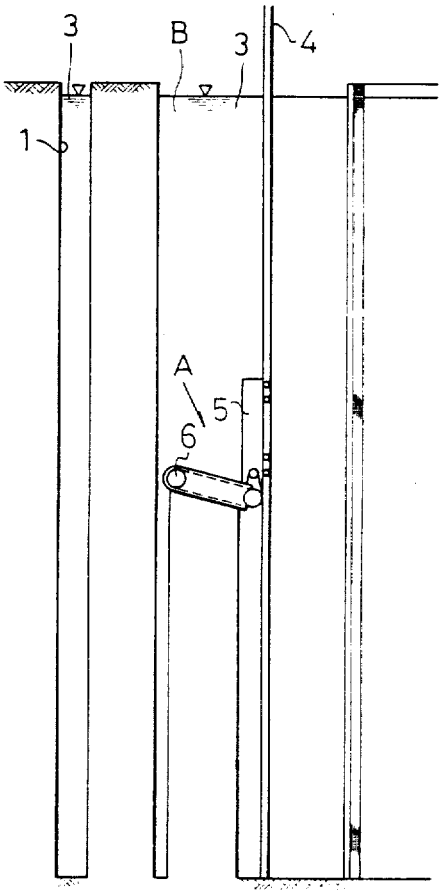
Figure 4A:
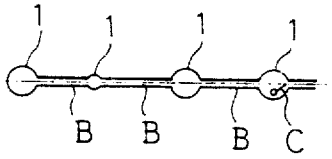
FIG. 4(*a*) is a schematic plan view of a step in earth preparation subsequent to the step illustrated in FIG. 3(*a*)
Figure 5A:
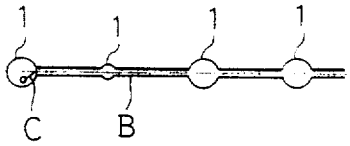
FIG. 5(*a*) is a schematic plan view of the completed slit trench shown in preparation in FIGS. 2–4, in which an impervious plastic membrane has been stretched into place.
Figure 4B:
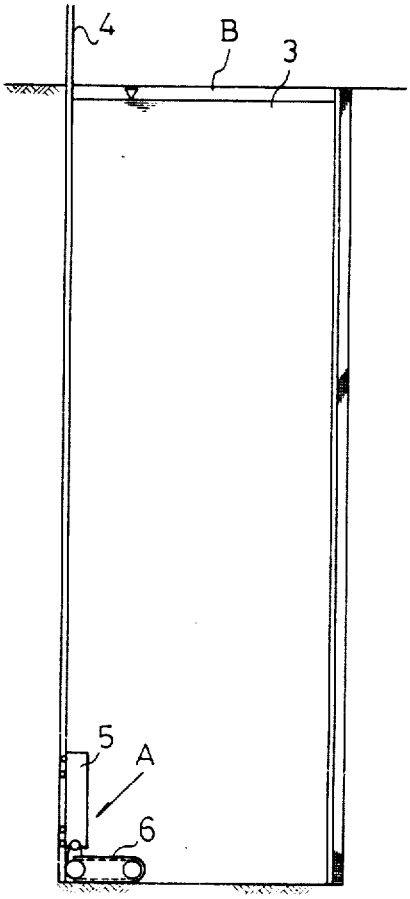
Figure 5B:
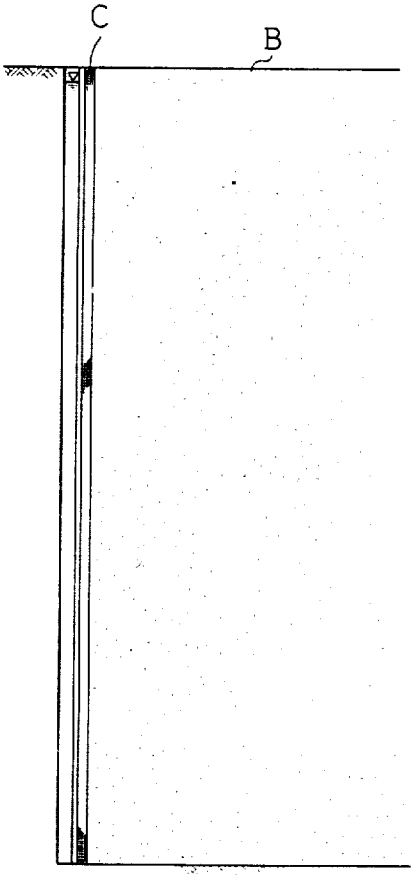

A hardening material D, FIG. 1, is charged into the trench B to solidify the mud 3 that remains in the trench upon completion of excavation, FIG. 3(*b*). Mortar, concrete or the like may be used as the hardening material. When the mud 3 is solidified, an underground continuous impervious wall of narrow width is completed which has the impervious sheet C interposed between the opposite side wall portions.

In the case of soil formations having satisfactory self-supporting character, the mud is unnecessary, and excavation without water is possible. After the stretching of the impervious sheet has been completed, soil mortar is charged in lieu of the mud hardener as filler into the trench.

After the stretching of the impervious sheet has been completed, soil mortar is charged in lieu of the mud hardener as filler into the trench.

(6) Another process

Figure 12A:
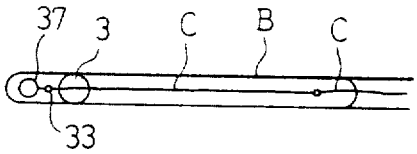
FIG. 12(*a*) is a schematic plan view of the slit trench of FIG. 9(*a*) prior to charging the slit trench with a hardening substance on both sides of the water-impervious plastic membrane.
Figure 11B:
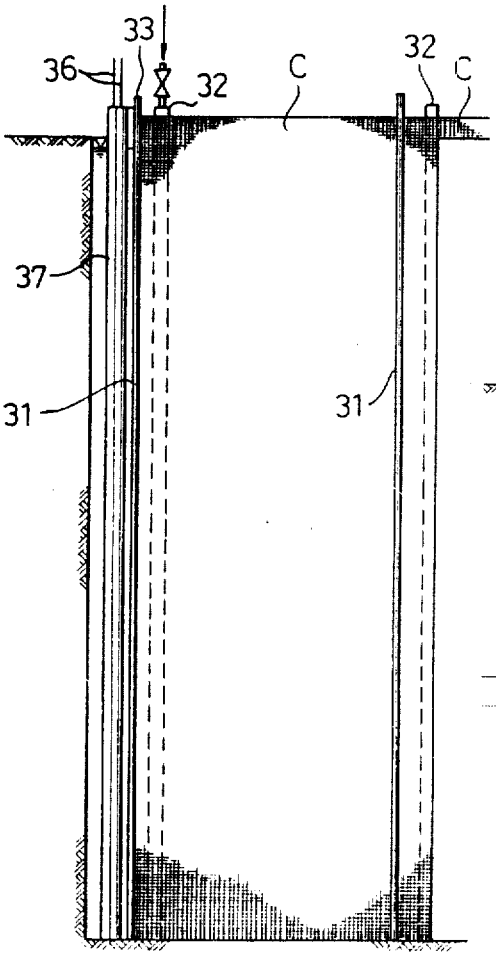
Figure 12B:
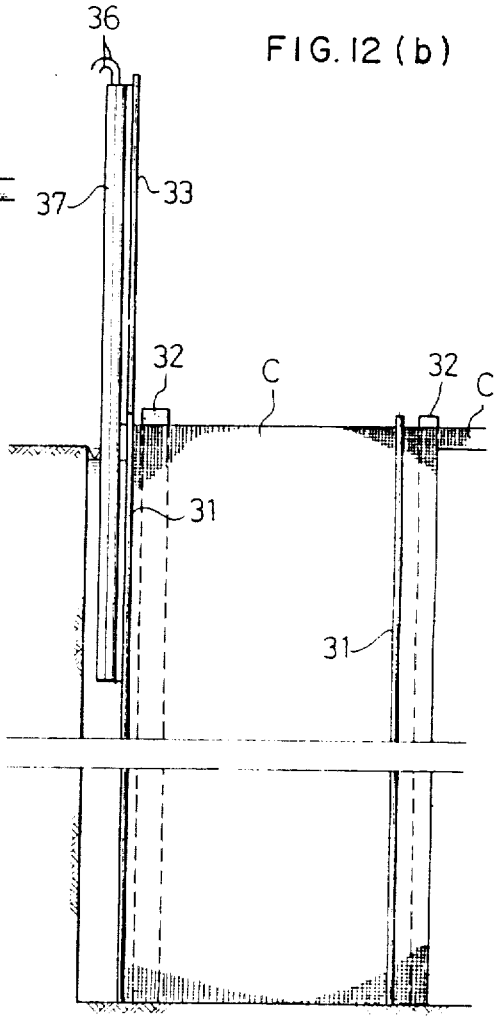
Figure 13:
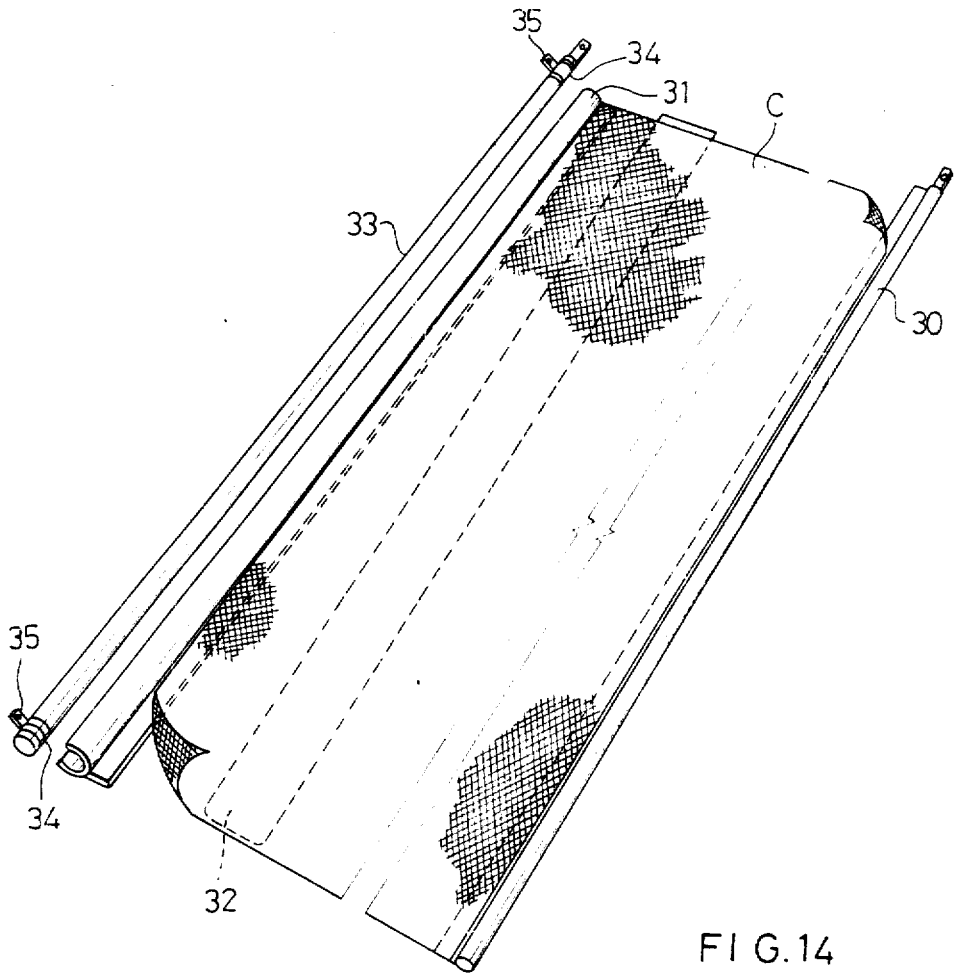
FIG. 13 is a perspective view of the water-impervious plastic membrane used in the invention together with preferred hardware used to deploy the membrane in a slit trench.

FIGS. 9 to 15 show another process, in which the impervious sheet C is lowered in a wound state on a roller into a trench B. One edge of the impervious sheet C is bonded over the entire length to an elongate bar-like sheet joiner 30. To the other end of the sheet C is bonded an elongate sheet joiner 31 having a C-shaped sectional profile, FIGS. 13 and 14. The impervious sheet C has an inflatable bladder 32 sewed to it near the sheet joiner 31 (FIG. 13).

Figure 14:
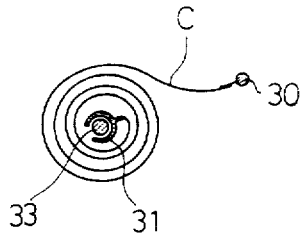
FIG. 14 is a plan view of the water-impervious plastic membrane rolled about the hardware shown in FIG. 13.

This impervious sheet C is wound on a joiner 33 serving as a roller. The joiner 33 is elongate, and it has rotatable rings 34 each tied to each of the upper and lower ends. Each of the rings 34 has a wire-mounting projection 35. The joiner 33 is fitted in the sheet joiner 31 having a C-shaped sectional profile. The impervious sheet C is wound on the outer periphery of the joiner 33, as shown in FIG. 14.

Figure 15:
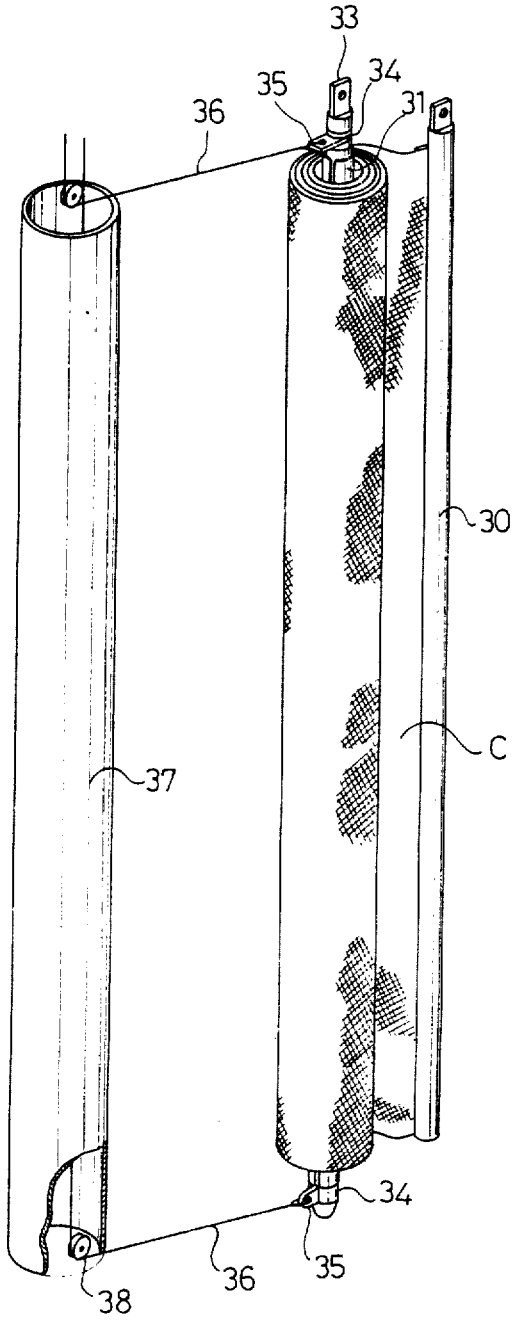
FIG. 15 is a partially fragmentary perspective view of the rolled water-impervious plastic membrane of FIG. 14 associated with the preferred hardware for unrolling the membrane.

Wires 36, FIG. 15, are tied to the respective wire-mounting projections 35 of the joiner 33 and are passed around sheaves 38 in a cylindrical post 37. The wire 36 is stretched upwardly within the post 37.

The impervious sheet C, wound on the joiner 33, and post 37 are lowered into the trench B at a fixed distance from each other. If there is an impervious sheet C which has already been stretched, the newly lowered impervious sheet C is connected to the preceding one by connecting the sheet joiner 31 to the joiner 33 of the preceding one, FIG. 13.

Figure 10A:
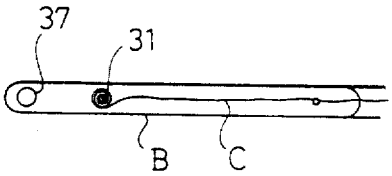
FIG. 10(*a*) is a schematic plan view of the slit trench shown in FIG. 9(*a*), and further showing therein the water-impervious plastic membrane partially unrolled.
Figure 9B:
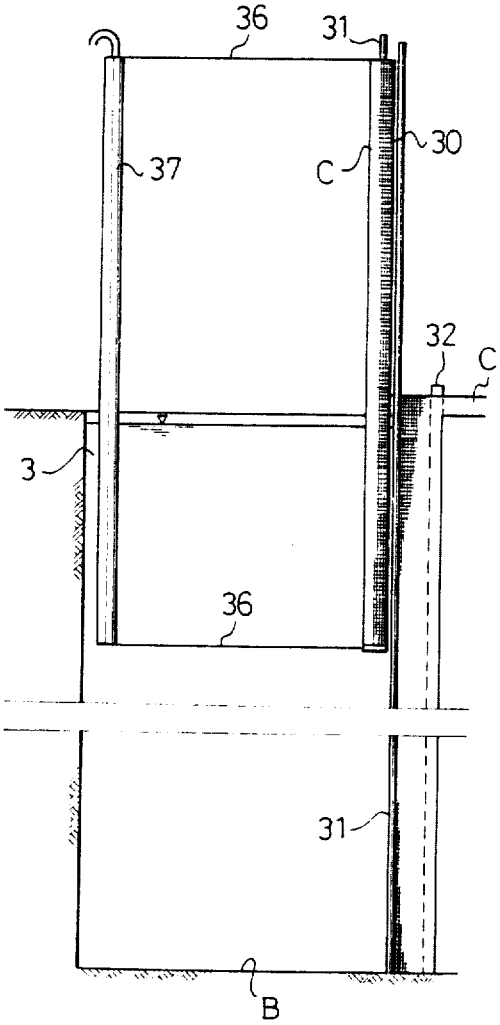
Figure 10B:
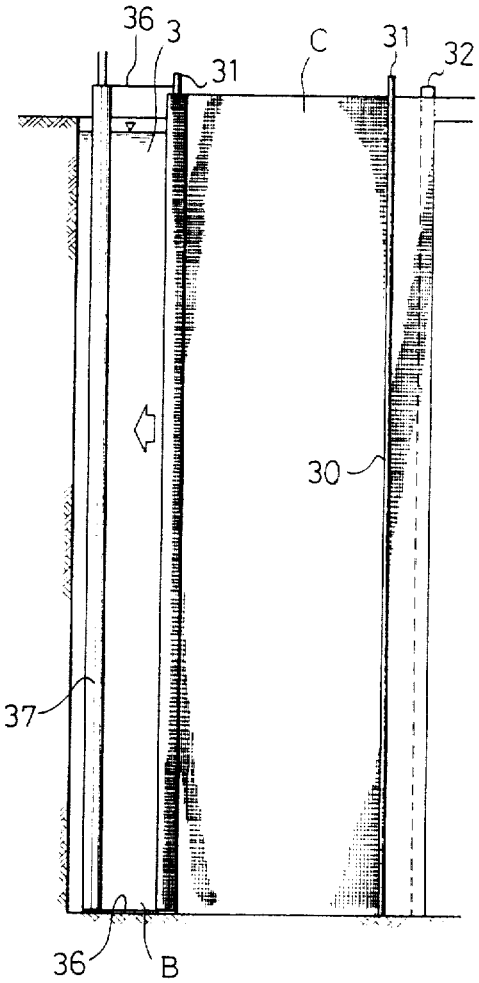
Figure 11A:
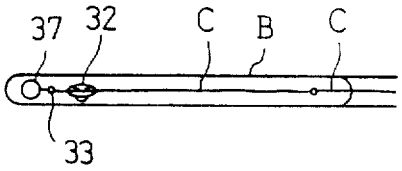
FIG. 11(*a*) is a schematic plan view of the slit trench of FIG. 9(*a*) showing the water-impervious plastic membrane fully unrolled.

The joiner 33 serving as the roller is pulled toward the post 37 by pulling the wires 36 stretched upwardly within the post 37. The impervious sheet C is paid off from the joiner 33 so that it is stretched in the trench B to longitudinally partition the trench B (FIG. 10).

The trench B is also partitioned transversely by charging water or air into the sewed bladder 32 of the impervious sheet C, FIG. 12(*a*).

A hardening material, e.g., mortar or concrete, is charged into the mud 3 in the trench B partitioned by the bladder 32 to solidify the mud, thus obtaining the impervious wall (FIG. 12). After the mud has been solidified, the post 37 and joiner 33 are pulled out from the trench B.

Figure 16A:
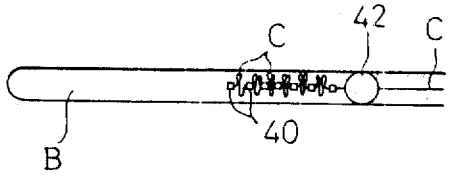
FIG. 16(*a*) is a plan view of another method of installing an underground impervious wall.
Figure 17A:
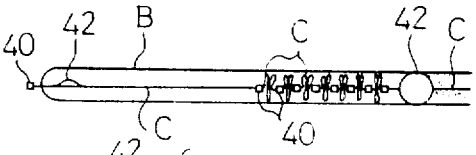
FIG. 17(*a*) is a plan view of the method shown in FIG. 16(*a*) in a second phase of installation of a water-impervious plastic membrane in a slit trench.
Figure 16B:
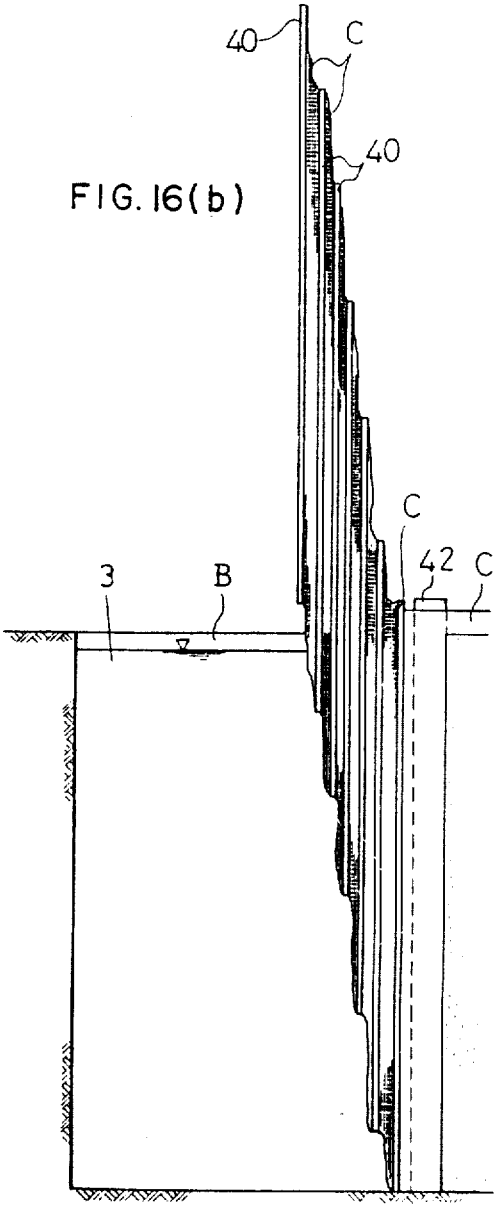
Figure 17B:
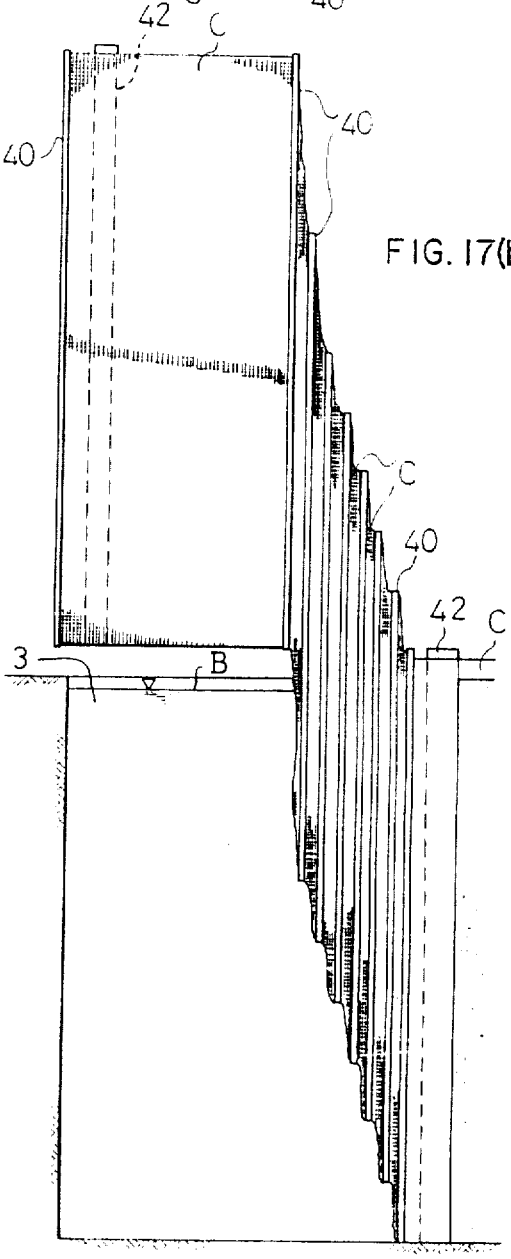
Figure 19:
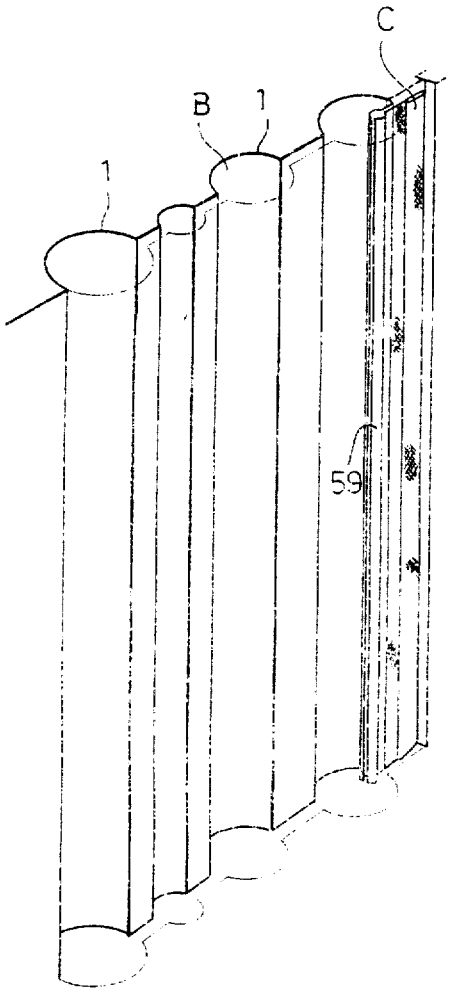
FIG. 19 is a perspective view of the first phase of yet another method of installing a water-impervious plastic membrane in a slit trench.

FIGS. 16 to 18 show a further process in which the impervious sheet C is lowered into the trench in a stretched state between posts. The posts 40 are secured to either the left or right end of one impervious sheet C. Fasteners 41 are tied to the opposite ends of the sheet C over the entire length. A pocket-like bladder 42 is sewed to the impervious sheet C near a post 40. A plurality of impervious sheets C are tied to one another by the fasteners 41. The impervious sheet C is lowered in a folded state together with posts 40 into the trench B. The required number of impervious sheets C, corresponding to the length of the trench B, are paid off to partition the trench B both longitudinally and transversely. Further, additional impervious sheets C are tied together by the fasteners 41, as shown in FIG. 18.

FIGS. 19 to 33 show a still further process, in which the impervious sheet is accordian pleated in a sheet cartridge which is lowered into the trench B.

Figure 27A:
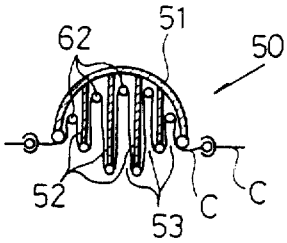
FIG. 27(*a*) is a plan view in section of the embodiment of the invention shown in FIG. 25.
Figure 27B:
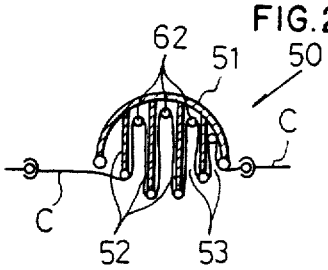
Figure 26:
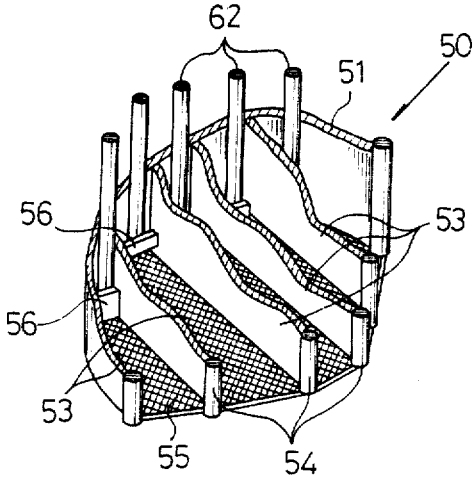
FIG. 26 is a fragmentary perspective view showing a lower portion of the sheet cartridge.
Figure 28:
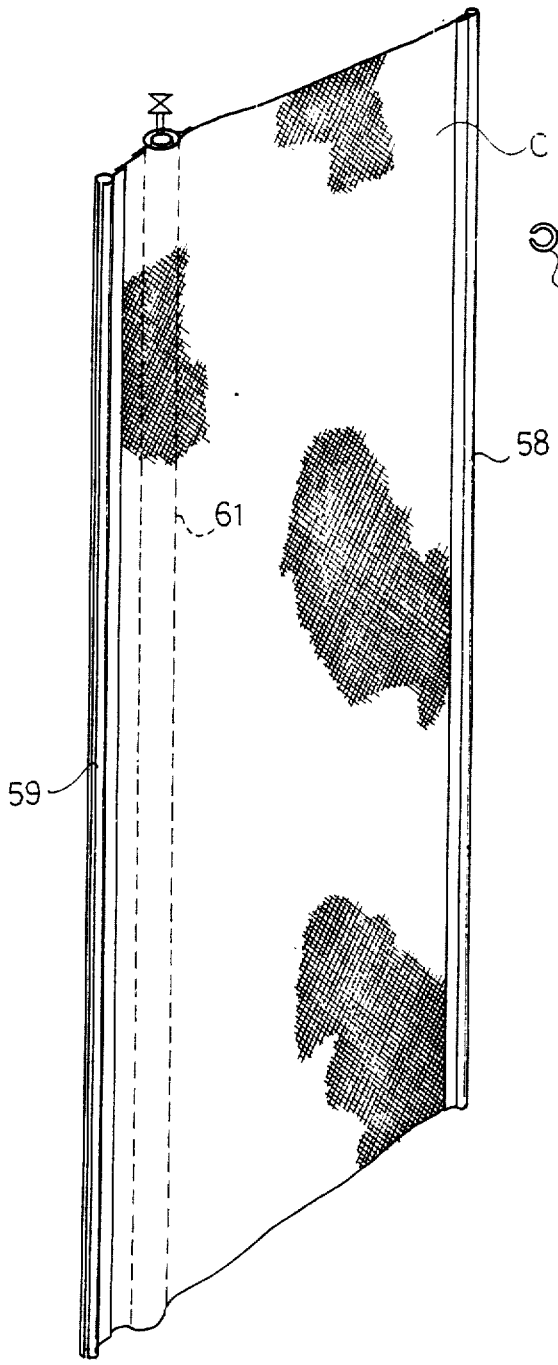
FIG. 28 is a perspective view showing a section of the water-impervious plastic membrane with a bladder tube insert.
Figure 29:
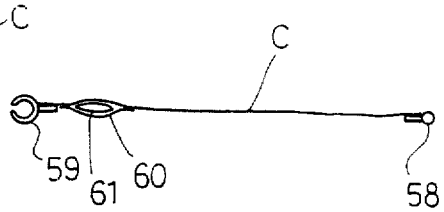
FIG. 29 is a plan view of FIG. 28.
Figure 30:
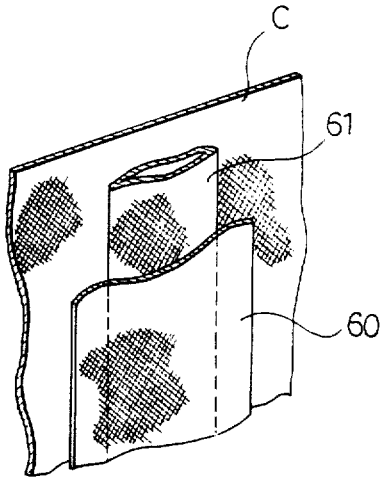
FIG. 30 is a fragmentary perspective view of the device shown in FIG. 28 with a modified bladder tube.

In FIGS. 25–30, reference numeral 50 designates the sheet cartridge. The cartridge 50, FIG. 25, consists of a shell 51 having a semi-circular sectional profile. Inside the shell 51, a vertically continuous folding groove 53 is formed by a plurality of parallel partition members 52. A rod-like guide member 54 is secured to the free edge of each partition member 52. The cartridge 50 has a bottom, FIG. 26, consisting of an expanded metal 55. Partitioning retainers 56 are secured to the bottom 55 near the shell 51 to partition the folding groove 53. As shown in FIG. 28, the impervious sheet C has an elongate rod-like sheet joiner 58 secured to one end and a sheet joiner 59, having a C-shaped sectional profile, secured to the other end. The impervious sheet C also has a pocket-like cover 60 bonded to it near the sheet joiner 59. An elongate trench-blocking bladder 61 is inserted in the cover 60.

Figure 25:
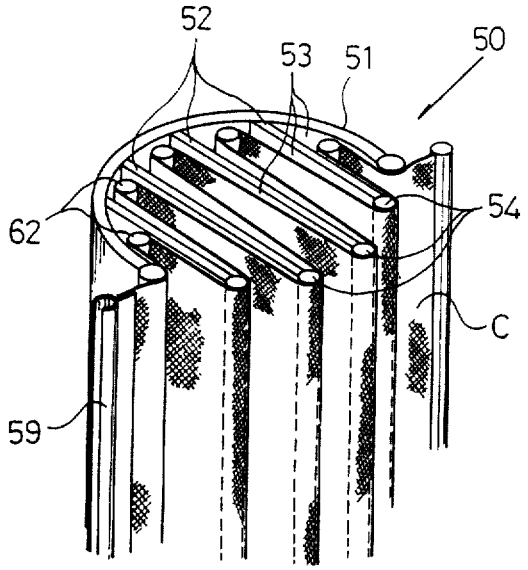
FIG. 25 is a fragmentary perspective view showing an upper portion of a sheet cartridge.

The impervious sheet C is formed in a folded state in the folding groove 53 of the sheet cartridge 50, FIG. 25. Each folded portion of the impervious sheet C extends to the bottom of each section of the folding groove 53. In the folded portion, a space rod 62 is provided between each partitioning retainer 56 and the shell 51 to prevent detachment of the impervious sheet.

Figure 31:
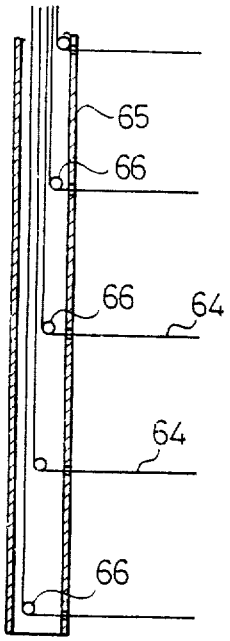
FIG. 31 is an elevational view in section showing a steel pipe and membrane stretching means used in a preferred embodiment of the invention.
Figure 32A:
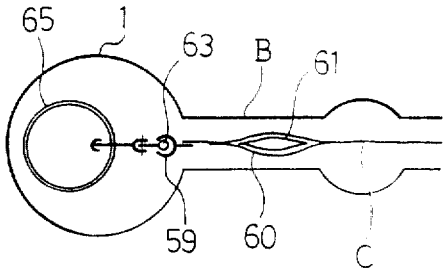
FIG. 32(*a*) is a schematic plan view of a deflated trench-blocking bladder, tube employed as an integral part of the water-impervious plastic membrane.
Figure 32B:
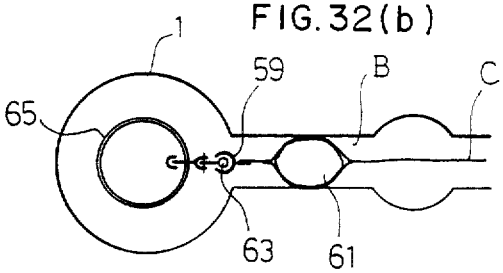
Figure 33:
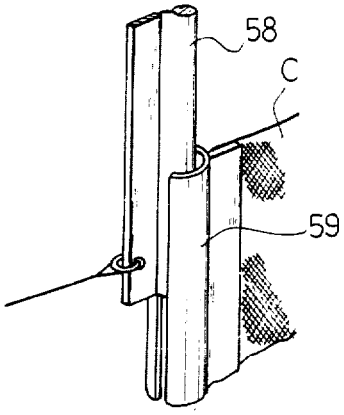
FIG. 33 is a fragmentary perspective view of a means for interconnecting sheets of water-impervious plastic membrane.

The impervious sheet C is lowered, after being folded into the cartridge 50, into the trench B. The elongate joiner 58 is fitted within the sheet joiner 59 of the impervious sheet C (FIG. 33). A plurality of wires 64 are tied to the joiner 58, and passed around sheaves 66 in a post 65 to be pulled upwards (FIG. 31).

Figure 20:
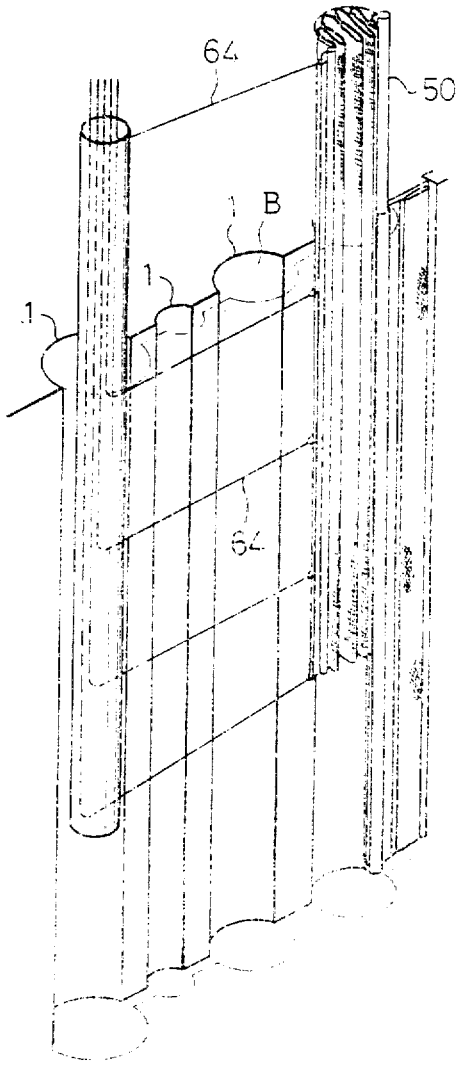
FIG. 20 is a perspective view of a second phase of the method shown, as started in FIG. 19.
Figure 21:
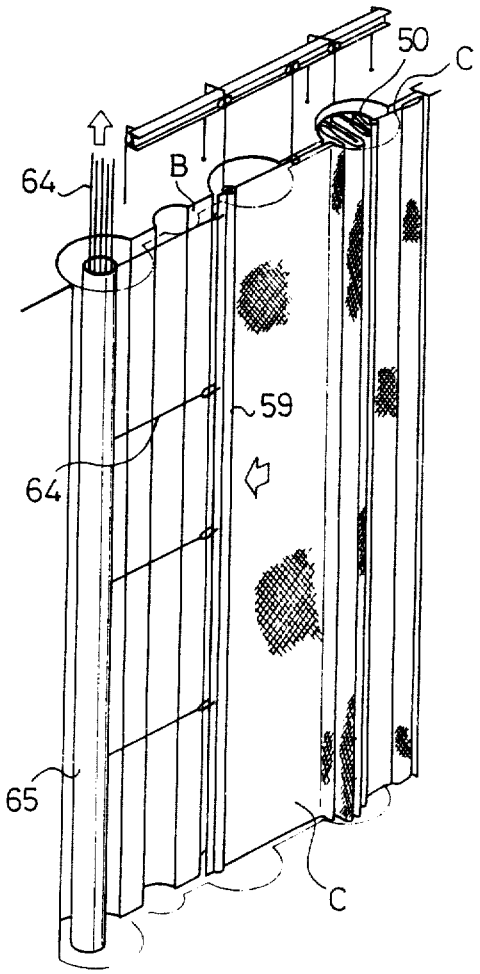
FIG. 21 is a perspective view of a third phase of the method shown as started in FIG. 19.

When lowering the sheet cartridge 50 into the trench B, the post 65 is also lowered into the trench B parallel to the cartridge (FIG. 20). If there is an already stretched impervious sheet C in the trench B, the new impervious sheet C is lowered with its sheet joiner 59 engaged in the sheet joiner 58 of the preceding sheet, whereby the two sheets C are joined together by the sheet joiners 58 and 59, FIG. 33.

Figure 22:
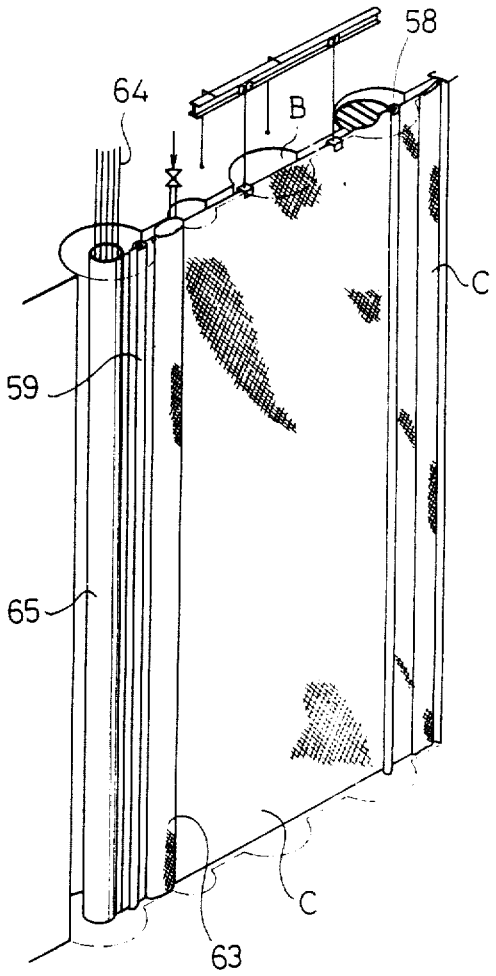
FIG. 22 is a perspective view of a fourth phase of the method shown as started in FIG. 19.
Figure 23:
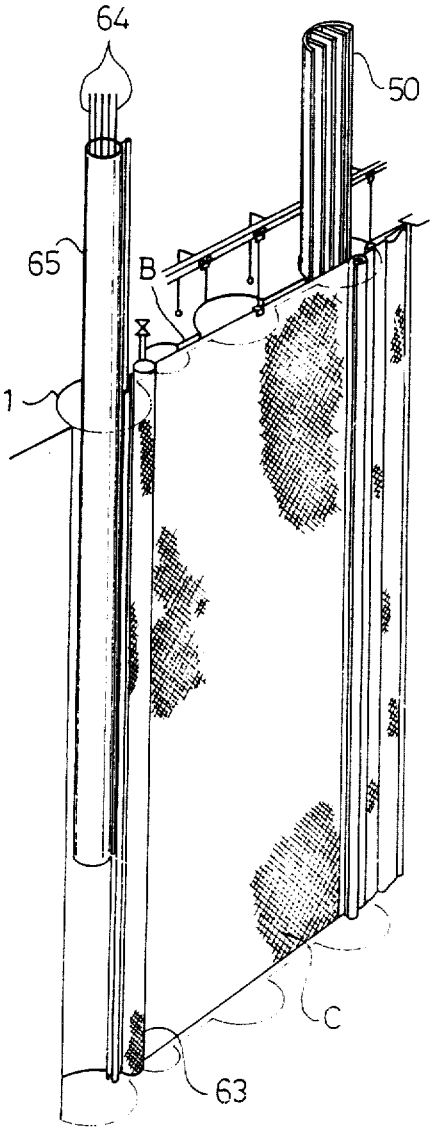
FIG. 23 is a perspective view of a fifth phase of the method shown as started in FIG. 19.
Figure 24:
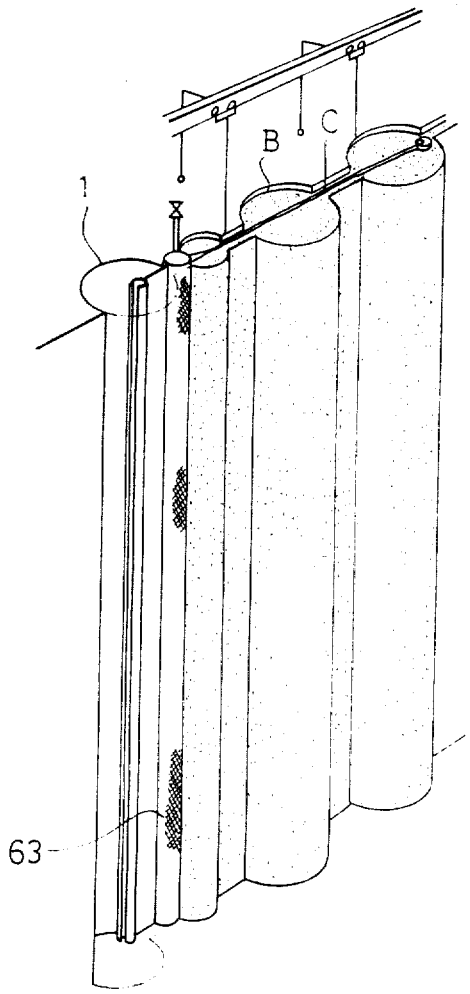
FIG. 24 is a perspective view of a sixth phase of the method shown as started in FIG. 19.

After the sheet has been lowered in cartridge 50, the wires 64 are passed through the post 65 and are tensioned to extend the lowered impervious sheet C. Thereafter, the space rods 62 are withdrawn one by one so that the impervious sheet C may be paid off from the folding groove 53 as shown in FIG. 27(*a*) and FIG. 27(*b*). The impervious sheet C is then stretched in the trench B such that it partitions the trench B as previously described (FIG. 22). Air or water is charged into the bladder 61 of the stretched impervious sheet C to transversely partition the trench B. Hardening material D is next poured into the partitioned trench B to solidify the mud 3.

Figure 34:
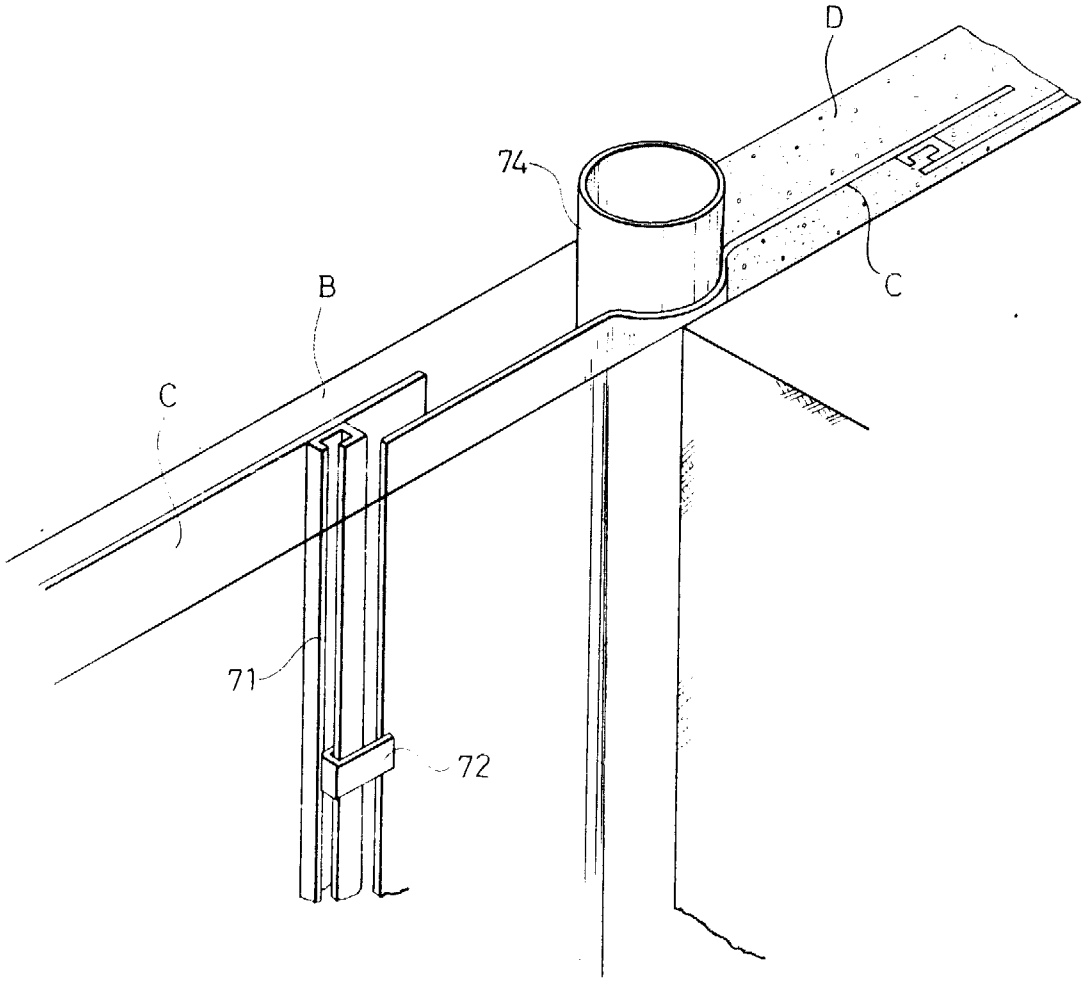
FIG. 34 is a fragmentary perspective view of another means for interconnecting sheets of water-impervious plastic membrane.
Figure 35:
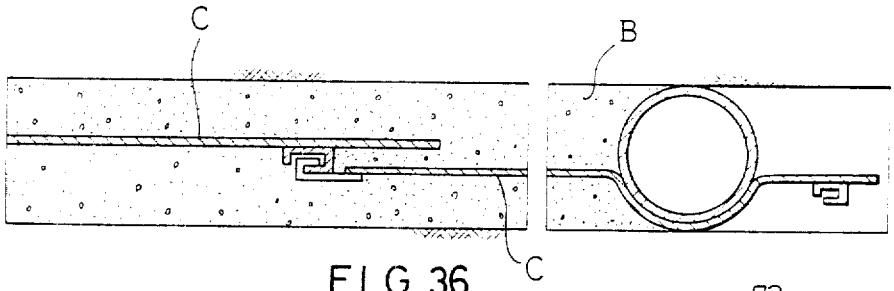
FIG. 35 is a sectional plan view of the apparatus shown in perspective in FIG. 34.
Figure 36:
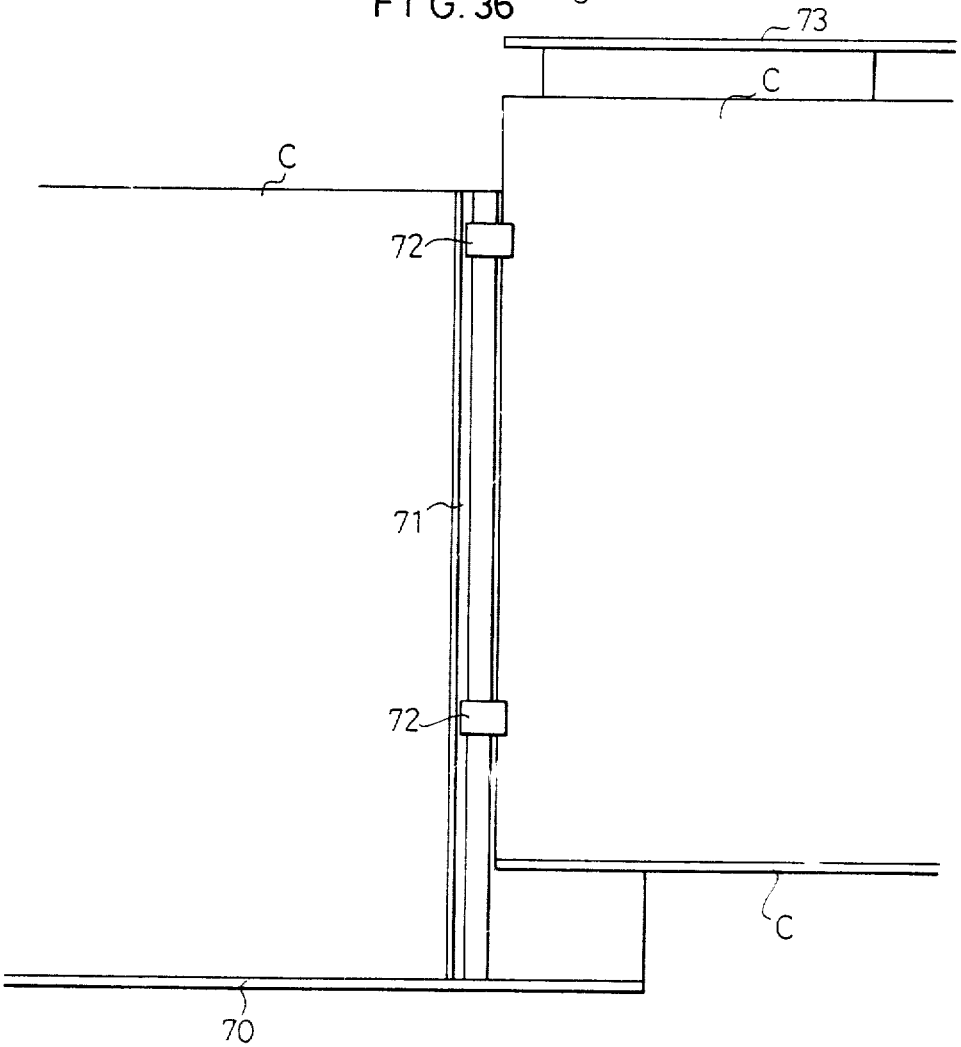
FIG. 36 is a partially assembled elevational view of the apparatus shown in FIGS. 34 and 35.

FIGS. 34 to 36 show another means for connecting the impervious sheets C. A bar-like weight 70, FIG. 36, is secured to the lower edge of the impervious sheet C. A plurality of impervious sheets are introduced one by one into the trench B. The trailing end of each preceding impervious sheet C is provided with a vertically continuous channel-shaped hook 71. To the leading end of the impervious sheet C are secured a plurality of clips 72 adapted to engage hook member 71. In the alternative, a single elongated clip may be adapted to continuously engage hook 71.

The impervious sheet C is lowered in a state suspended from a bar-like hanger 73, FIG. 36, into the trench B by a crane or the like. When introducing a subsequent impervious sheet C to a preceding impervious sheet C, the clip 72 of the subsequent impervious sheet C is engaged in the hook 71 of the preceding impervious sheet C. In this manner, a plurality of impervious sheets C are continuously connected and introduced into the trench B to partition the trench B both longitudinally and transversely.

When solidifying the mud, the trench B may be partitioned by driving locking pipes 74 in the trench in order that a given solidification range of trench is delimited so as to keep the last set of hooks 71 and clips 72 free from solidified mud while impervious sheets are still being placed in the open end of trench B.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. A method for installing an underground continuous impervious wall comprising the steps of:

excavating a gutter in the ground;

accommodating an impervious sheet in a folded state in a sheet cartridge having a vertically continuous folding groove section formed by a plurality of parallel partition members;

securing said impervious sheet via detachable space rods to folded portions of said impervious sheet located at the bottom of each section of said folding groove;

lowering said cartridge with said impervious sheet therein into said gutter;

stretching said impervious sheet in said gutter by paying off said impervious sheet by withdrawing said space rods;

thus partitioning said gutter in the width direction thereof;

charging a hardening material against the opposite side surfaces of said impervious sheet in said gutter; and thereby forming an impervious wall with said impervious sheet intervening between opposite side wall portions.

2. A method for installing an underground continuous impervious wall according to claim 1, wherein mud is solidified by the hardening material charged into said gutter.

3. A method for installing an underground continuous impervious wall according to claim 1, wherein soil mortar is charged as the hardening material into said gutter.

4. In a slit trench having opposed walls, an underground water-impervious wall comprising: a series of interconnected sheets of water-impervious membrane, each sheet being vertically suspended between first and second supporting rods positioned vertically in said trench; and means to sequentially position and to tension each sheet in said trench; said tensioning means comprising: a tensioning stanchion anchored vertically in said trench and spaced laterally from said second supporting rod; sheet tensioning means secured between said second supporting rod and said tensioning stanchion; and means associated with said tensioning stanchion to tension said sheet tensioning means.

5. The device of claim 4, wherein said sheet tensioning means comprises a plurality of wires secured along the longitudinal axis of said second supporting rod and to extend horizontally in a vertical plane over to said tensioning stanchion; pulley means secured to said tensioning stanchion adapted to receive and to direct said plurality of wires to wire tensioning means.

6. The device of claim 5, wherein said tensioning stanchion is a hollow tube; said pulley means are mounted within said tube; and entry means into said cylinder are adapted to access said wires to threadedly engage said pulley means.

7. The device of claim 4, wherein each sheet is secured with a bar weight secured to the bottom edge of the sheet to weight-stretch said sheet downwardly in a vertical plane.

8. The device of claim 4, including means to position a sheet in said trench comprising: a sheet cartridge having means to contain a compacted sheet therein; and means to pay out said compacted sheet from said cartridge in a vertical plane within said trench.

* * * * *